US006567625B1

(12) United States Patent
Tatematsu et al.

(10) Patent No.: US 6,567,625 B1
(45) Date of Patent: May 20, 2003

(54) IMAGE FORMING APPARATUS AND PROCESS CARTRIDGE WITH DELAYED ROTATION OF PHOTOSENSITIVE MEMBER

(75) Inventors: Hideki Tatematsu, Hyogo (JP); Kazumasa Hayashi, Hyogo (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/575,393

(22) Filed: May 22, 2000

(30) Foreign Application Priority Data

May 27, 1999 (JP) ..... 11-147423

(51) Int. Cl.[7] ..... G03G 15/02; G03G 15/00; G03G 21/00

(52) U.S. Cl. ..... 399/75; 399/115; 399/116; 399/176

(58) Field of Search ..... 399/75, 98, 100, 399/111, 115, 116, 174, 176, 149, 150

(56) References Cited

U.S. PATENT DOCUMENTS

| | | | | | |
|---|---|---|---|---|---|
| 4,719,491 | A | * | 1/1988 | Katoh et al. | 399/75 |
| 5,081,504 | A | * | 1/1992 | Morisawa et al. | 399/350 |
| 5,272,505 | A | * | 12/1993 | Shishido et al. | 399/176 X |
| 5,404,213 | A | | 4/1995 | Okano et al. | |
| 5,416,565 | A | * | 5/1995 | Noda | 399/176 |
| 5,541,717 | A | * | 7/1996 | Saito et al. | 399/150 |
| 5,689,770 | A | * | 11/1997 | Kurokawa et al. | 399/176 X |
| 5,733,235 | A | * | 3/1998 | Waku et al. | 399/176 X |
| 5,757,508 | A | | 5/1998 | Murata | 399/168 X |
| 5,758,229 | A | * | 5/1998 | Kyung | 399/100 |
| 5,835,825 | A | | 11/1998 | Maruta | |
| 5,852,758 | A | * | 12/1998 | Wibbels | 399/176 |
| 5,864,736 | A | * | 1/1999 | Shimada et al. | 399/149 |
| 5,878,312 | A | * | 3/1999 | Hisada | 399/149 |
| 5,897,243 | A | * | 4/1999 | Komatsubara et al. | 399/98 |
| 5,970,279 | A | * | 10/1999 | Sakaizawa et al. | 399/149 X |
| 6,035,158 | A | * | 3/2000 | Asakura et al. | 399/112 X |
| 6,047,145 | A | | 4/2000 | Shigezaki et al. | |
| 6,141,516 | A | * | 10/2000 | Law et al. | 399/176 |

FOREIGN PATENT DOCUMENTS

| | | | |
|---|---|---|---|
| JP | 1-195459 | * | 8/1989 |
| JP | 3-7966 | | 1/1991 |
| JP | 4-34566 | * | 2/1992 |
| JP | 4-140769 | * | 5/1992 |
| JP | 4-298771 | | 10/1992 |
| JP | 4-328162 | | 11/1992 |
| JP | 5-117434 | | 5/1993 |
| JP | 5-125209 | | 5/1993 |
| JP | 6-35257 | | 2/1994 |
| JP | 6-301272 | | 10/1994 |
| JP | 7-146602 | | 6/1995 |
| JP | 7 281502 | | 10/1995 |
| JP | 8-15950 | | 1/1996 |
| JP | 10-171213 | | 6/1998 |
| JP | 10-213950 | * | 8/1998 |

* cited by examiner

*Primary Examiner*—Fred L. Braun
(74) *Attorney, Agent, or Firm*—Merchant & Gould, P.C.

(57) ABSTRACT

An image forming apparatus and a process cartridge capable of satisfying both a high quality image and an excellent maintenance property with a simple configuration. A photosensitive member and a charging roller that is a member rotating in contact with the photosensitive member are brought into contact with each other in the image forming process. When an image forming operation starts from a standstill, the charging roller is rotated before the photosensitive member starts to be rotated. Furthermore, before the photosensitive member stars to be rotated, a reversed bias voltage that is a voltage opposite to the bias voltage at usual development time is applied between the members rotating in contact with the photosensitive member and the photosensitive member. The time for which the charging roller is rotated before the photosensitive member starts to be rotated is set to be 0.01–2.0 seconds and is changed in accordance with the number of pages printed and is reduced each time the number of pages printed reaches a predetermined number.

56 Claims, 5 Drawing Sheets

IMAGE FORMING APPARATUS AND PROCESS CARTRIDGE WITH DELAYED ROTATION OF PHOTOSENSITIVE MEMBER

FIELD OF THE INVENTION

The present invention relates to an image forming apparatus and process cartridge used for, for example, a monochrome or color printer, copying machine, facsimile, and the like.

BACKGROUND OF THE INVENTION

An image forming apparatus such as an electrophotographic copier, an electrophotographic printer or the like, employs a method of obtaining printed matters through steps of: homogeneously charging a surface of a photosensitive member; forming an electrostatic latent image by exposure; developing the latent image by attaching toner thereto; transferring the toner on the surface of the photosensitive member to a subject to accept transfer such as paper; and fixing the toner image on the subject. In each step, a member that is directly pressed onto and slides on the photosensitive member, such as a charging roller, a developing roller, a transfer roller, a cleaning roller, and the like, may be used. It is desirable to use a member having each respective function that does not easily damage the surface of the photosensitive member, and does not contaminate the photosensitive member. For example, a conductive developing roller having an appropriate elasticity generally is used, in a non-magnetic one-component (contact) developing process, which is employed in a copier, printer, or the like, which forms a full color image by image forming process using an electrophotographic method. The generally usable conductive elastic member of this kind includes, for example, a composition in which a conductivity-providing agent is contained in natural rubber or various kinds of synthetic rubber. For example, JP 3-7966A discloses the use of an EPDM (ethylene-propylene-diene copolymer), JP 4-328162A discloses the use of a silicone rubber, and JP 5-117434A discloses the use of an urethane rubber.

Furthermore, as the conductive roller used for the charging roller or the transfer roller, JP 7-281502A discloses the use of conductive fluorocarbon silicone rubber and N-methyl methoxized nylon, as examples; and JP 8-15950A discloses the use of a silicone rubber foam, as an example.

Among the rollers in contact with the photosensitive member, the rollers using silicone rubber or urethane rubber are more excellent in stability of the resistance value in manufacturing as compared with the roller using EPDM. However, when either silicone rubber or urethane rubber is used in contact with the photosensitive member, a plasticizer or a softener, which is contained in the above-mentioned rubbers, may bleed from the surface of the roller using silicone rubber or urethane rubber to contaminate the photosensitive member. Furthermore, if sulfur or a derivative thereof is used for a vulcanizing agent for rubber, a remaining component of such a vulcanizing agent may contaminate the photosensitive member.

In order to solve such problems, JP 5-125209A or JP 7-146602 discloses a technique of coating the surface of roller, however, such techniques are not sufficient.

In the current distributing products, such a problem is solved by providing a disjunction mechanism that does not bring each roller into contact with the photosensitive member other than at the development time. However, such a disjunction mechanism makes the apparatus complicated, and raises the cost.

A general cartridge used in a monochrome printer is configured by integrating a toner hopper, a developer, and a photosensitive member into one piece, and thus it is excellent in a maintenance property. However, in most color cartridges, in order to solve the above-mentioned problems, a developer and the photosensitive member are formed separately. Therefore, it is difficult to satisfy both the high quality image by a developing roller made of silicone rubber and the excellent maintenance property that is the same level as that of monochrome cartridges.

SUMMARY OF THE INVENTION

It is an object of the present invention to provide an image forming apparatus and a process cartridge capable of satisfying both the high quality image and the improved maintenance property with a simple configuration.

In order to attain the above-mentioned object, a first configuration of an image forming apparatus according to the present invention includes a photosensitive member and members rotating in contact with the photosensitive member. When an image forming operation starts from a standstill, the members rotating in contact with the photosensitive member are rotated before the photosensitive member starts to be rotated. According to the first configuration of the image forming apparatus, it is possible to scrape off only a contaminated portion on the contacting portion between the members rotating in contact with the photosensitive member and the photosensitive member by the member that is a contamination source itself, while the structure is kept simple. Thus, even if urethane rubber or silicone rubber is used for a material of the members, for example, a charging roller, a developing roller, or the like, which rotate in contact with the photosensitive member, it is possible to prevent the contamination of the photosensitive member. Furthermore, it is not necessary to form a developer and a photosensitive member as separate units. Therefore, according to first configuration of the image forming apparatus, it is possible to attain the image forming apparatus capable of satisfying both the high quality image and the improved maintenance property with a simple configuration.

Furthermore, a second configuration of an image forming apparatus according to the present invention includes a photosensitive member and members rotating in contact with the photosensitive member. Before the photosensitive member starts to be rotated, a reversed bias voltage that is an opposite voltage to the bias voltage at usual development time is applied between the members rotating in contact with the photosensitive member and the photosensitive member. According to the second configuration of the image forming apparatus, charges are filled onto the contaminated portion on the photosensitive member, and thus it is possible to suppress the appearance of a hollow white printing on a half tone image.

Furthermore, it is preferable in the second configuration of the image forming apparatus according to the present invention that an application time of the reversed bias voltage is 0.01–2.0 seconds.

Furthermore, it is preferable in the second configuration of the image forming apparatus according to the present invention that the application time of the reversed bias voltage is changed in accordance with the number of pages printed. In this case, it is further preferable that the application time of the reversed bias voltage is reduced each time the number of pages printed reaches a predetermined number. When the number of pages printed is increased and toner is deteriorated, the deteriorated toner is attached to the portion to which the reversed bias voltage is applied, on the photosensitive member. As a result, black lines are generated.

Furthermore, in this case, it is further preferable that the changing degree of the application time of the reversed bias voltage is varied in accordance with the toner being applied whether black toner or cyan toner, magenta toner, and yellow toner. This is because the black toner contains a carbon pigment and has different characteristics from those of cyan toner, magenta toner, and yellow toner (i.e., color toner).

Furthermore, a third configuration of an image forming apparatus according to the present invention includes a photosensitive member and members rotating in contact with the photosensitive member. When an image forming operation starts from a standstill, the members rotating in contact with the photosensitive member are rotated before the photosensitive member starts to be rotated, and while the members rotating in contact with the photosensitive member are rotated before the photosensitive member starts to be rotated, a reversed bias voltage that is opposite voltage to the bias voltage at usual development time is applied between the members rotating in contact with the photosensitive member and the photosensitive member. According to the third configuration of the image forming apparatus, while the members rotating in contact with the photosensitive member are rotated before the photosensitive member starts to be rotated, toner can be prevented from scattering and the contaminants can be attracted. This effect is exhibited significantly in a case where the member rotating in contact with the photosensitive member is a developing member on the surface of which toner exists in the form of a thin film.

Furthermore, it is preferable that the third configuration of the image forming apparatus according to the present invention further includes a member for removing electricity, which is in contact with the photosensitive member, so as to remove electricity after transfer. With such a preferred configuration, since excess charges on the photosensitive member can be removed, it is possible to prevent black lines from appearing on a non-printed part of the recording paper.

Furthermore, it is preferable in the first or third configuration of the image forming apparatus according to the present invention that a time for which the members rotating in contact with the photosensitive member are rotated before the photosensitive member starts to be rotated is 0.01–2.0 seconds. When the time is less than 0.01 seconds, the effect of scraping off the contaminants is lowered; and when the time is more than 2.0 seconds, the lifetime of each roller is shortened and it takes an unnecessarily longer time to perform a first copy.

Furthermore, it is preferable in the first or third configuration of the image forming apparatus according to the present invention that the time for which the members rotating in contact with the photosensitive member are rotated before the photosensitive member starts to be rotated is changed in accordance with the number of pages printed. In this case, it is further preferable that the time for which the members rotating in contact with the photosensitive member are rotated before the photosensitive member starts to be rotated is reduced each time the number of pages printed reaches the predetermined number. In this case, it is still further preferable that the changing degree of the time for which the members rotating in contact with the photosensitive member before the photosensitive member starts to be rotated is varied in accordance with whether toe toner is black toner or cyan toner, magenta toner, and yellow toner.

Furthermore, it is preferable in the second or third configuration of the image forming apparatus according to the present invention that the absolute value of the reversed bias voltage is 5–300 V. When the value is less than 5V, it is not possible to suppress the scattering of toner sufficiently; and when the value is more than 300V, the contamination by toner to the member rotating in contact with the photosensitive member is increased, thus shortening the lifetime of the member rotating in contact with the photosensitive member.

Furthermore, it is preferable in the second configuration of the image forming apparatus according to the present invention that the amount of the reversed bias voltage is changed in accordance with the number of pages printed. In this case, it is further preferable that the amount of reversed bias voltage is reduced each time the number of pages printed reaches a predetermined number. In this case, it is still further preferable that the changing degree of the reversed bias voltage is changed in accordance with whether the toner is black toner or cyan toner, magenta toner, and yellow toner.

Furthermore, it is preferable in the first or third configuration of the image forming apparatus according to the present invention that the members rotating in contact with the photosensitive member are rollers made of rubber and formed around an axis core, and wherein the rubber has a hardness of 30–80 degrees, a thickness of 0.5–7 mm, and a pressing force with respect to the photosensitive member of 0.5–1.2 kg. In this case, it is further preferable that the rubber has a hardness of 40–70 degrees, and a thickness of 1–5 mm.

Furthermore, in the first to third configurations of the image forming apparatus according to the present invention, the members rotating in contact with the photosensitive member include, for example, a charging roller or a developing roller. In this case, silicone rubber or urethane robber is used for the material of the charging roller or the developing roller.

Furthermore, a process cartridge of a first configuration according to the present invention includes a photosensitive member and members rotating in contact with the photosensitive member. When an image forming operation starts from a standstill, the members rotating in contact with the photosensitive member are rotated before the photosensitive member starts to be rotated.

Furthermore, a process cartridge of a second configuration according to the present invention includes a photosensitive member and members rotating in contact with the photosensitive member. Before the photosensitive member starts to be rotated, a reversed bias voltage that is an opposite voltage to the bias voltage at usual development time is applied between the members rotating in contact with the photosensitive member and the photosensitive member.

Furthermore, it is preferable in the second configuration of the process cartridge according to the present invention that an application time of the reversed bias voltage is 0.01–2.0 seconds.

Furthermore, it is preferable in the second configuration of the process cartridge according to the present invention that the application time of the reversed bias voltage is changed in accordance with the number of pages printed. In this case, it is further preferable that the application time of the reversed bias voltage is reduced each time the number of pages printed reaches a predetermined number.

Furthermore, a process cartridge of a third configuration according to the present invention includes a photosensitive member and members rotating in contact with the photosensitive member. When an image forming operation starts from a standstill, the members rotating in contact with the photosensitive member are rotated before the photosensitive member starts to be rotated, and while the members rotating in contact with the photosensitive member are rotated before the photosensitive member starts to be rotated, a reversed bias voltage that is opposite voltage to the bias voltage at usual development time is applied between the members rotating in contact with the photosensitive member and the photosensitive member.

Furthermore, it is preferable that the third configuration of the process cartridge according to the present invention further includes a member for removing electricity, which is in contact with the photosensitive member, so as to remove electricity after transfer.

Furthermore, it is preferable in the first or third configuration of the process cartridge according to the present invention that a time for which the members rotating in contact with the photosensitive member are rotated before the photosensitive member starts to be rotated is 0.01–2.0 seconds.

Furthermore, it is preferable in the first or third configuration of the process cartridge according to the present invention that the time for which the members rotating in contact with the photosensitive member are rotated before the photosensitive member starts to be rotated is changed in accordance with the number of pages printed. In this case, it is further preferable that the time for which the members rotating in contact with the photosensitive member are rotated before the photosensitive member starts to be rotated is changed in accordance with the number of pages printed.

Furthermore, it is preferable in the second or third configuration of the process cartridge according to the present invention that the absolute value of the reversed bias voltage is 5–300V.

Furthermore, it is preferable in the second configuration of the process cartridge according to the present invention that the amount of the reversed bias voltage is changed in accordance with the number of pages printed. In this case, it is preferable that the amount of reversed bias voltage is reduced each time the number of pages printed reaches a predetermined number.

Furthermore, it is preferable in the first or third configuration of the process cartridge according to the present invention that the members rotating in contact with the photosensitive member are rollers made of rubber and formed around an axis core, and wherein the rubber has a hardness of 30–80 degrees, a thickness of 0.5–7 mm, and a pressing force with respect to the photosensitive member of 0.5–1.2 kg. In this case, it is further preferable that the rubber has a hardness of 40–70 degrees, and a thickness of 1–5 mm.

Furthermore, in the first to third configurations of the process cartridge according to the present invention, the members rotating in contact with the photosensitive member include, for example, a charging roller or a developing roller. In this case, silicone rubber or urethane robber is used for the material of the charging roller or the developing roller.

DETAILED DESCRIPTION OF THE INVENTION

Figure 1:
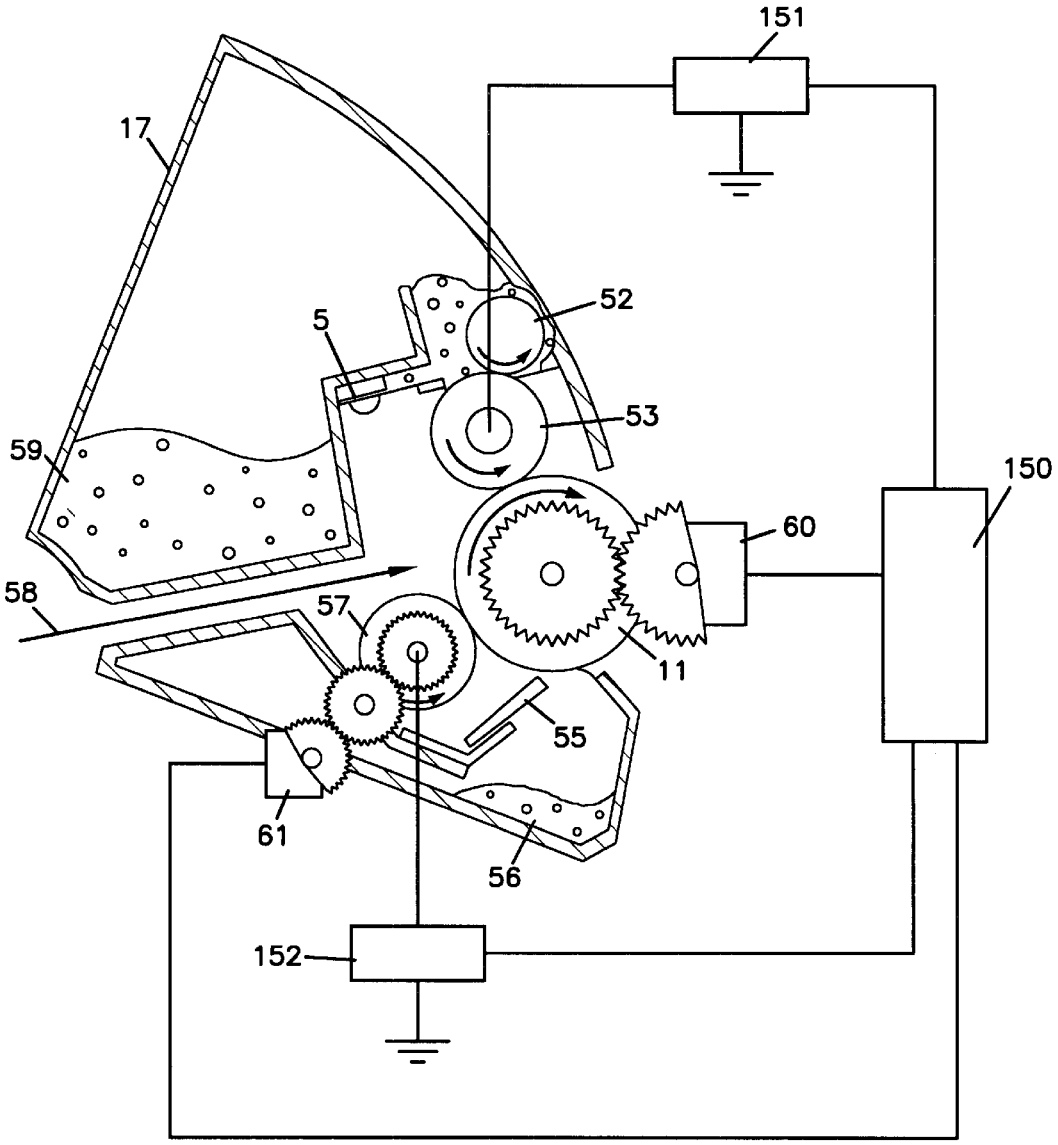
FIG. 1 is a cross-sectional view showing a process cartridge in a first embodiment according to the present invention.

The following is a detailed explanation of the present invention with reference to the embodiments.

The contamination of the photosensitive member means that a photosensitive member is contaminated when a charging roller or a developing roller made of urethane rubber or silicone rubber is left in contact with the photosensitive member, and a plasticizer, softener or vulcanizing agent, oligomer component of rubber, or the like, bleed from the surface of the roller so as to contaminate the contacting photosensitive member.

In the image forming apparatus and process cartridge of the present invention, when the image forming operation starts from a standstill, the members rotating in contact with the photosensitive member, for example, a charging roller, a developing roller, a transfer roller, a cleaning roller, etc., are rotated before the photosensitive member starts to be rotated, while leaving the photosensitive member at a standstill.

As an example, a developing roller made of silicone rubber will be explained.

It is known that if the developing roller made of silicone robber is used, the oligomer component from the silicon rubber leaks out so as to be attached onto the surface of the photosensitive member with the passage of time, thus significantly changing the surface property of the photosensitive member. This is a state in which the silicone oil is attached to the photosensitive member. In this state, the mold releasability is remarkably different between the contaminated portion and the other portion, thus changing the state in which toner is attached. As a result, on the image, a white line or black line emerges in the portion in which the developing roller and the photosensitive member are in contact with each other. If contaminants are removed, defects on the image can be avoided. However, if a new cleaning mechanism for polishing the whole surface of the photosensitive member is provided, the whole surface of the photosensitive member is cleaned off, thus affecting the non-contaminated portion. Furthermore, such a new cleaning mechanism makes the structure complicated.

Since the contaminated portion is limited to the portion that is in contact with the roller, it is desirable to clean off only the contacting portion. The present invention employs a configuration in which a roller that is a contaminant source is rotated before the photosensitive member when the image forming operation starts from a standstill. Thus, it is possible to scrape off only the contaminated portion in which the roller is in contact with the photosensitive member by using the roller itself, i.e., a contaminant source.

Since toner is present on the surface of the developing roller in the form of a thin layer, the effect of scraping off the toner is extremely high. This effect is not dependent upon the rotation direction of the roller. The rollers rotating in contact with the photosensitive member may be rotated at the same speed as that of the photosensitive member or at a different speed from that of the photosensitive member.

It is desirable that the time in which each roller rotating in contact with the photosensitive member is rotated before the photosensitive member starts to be rotated is 0.01–2.0 seconds. When the time is less than 0.01 seconds, the effect of scraping off contaminants is reduced, and when the time is more than 2.0 seconds, the lifetime of each roller is shortened and it takes an unnecessarily longer time to perform a first copy. This is remarkably observed in a color image forming apparatus for printing by switching cartridges of four colors. That is, in order to perform a first copy, four times extra time is necessary as compared with monochrome. Therefore, it is desirable that the time for rotating each roller in advance is set to the minimum possible time for removing contaminants.

Furthermore, the image forming apparatus and process cartridge of the present invention has a configuration of applying the reversed bias voltage, i.e., the bias voltage that is opposite the usual voltage at development time, between the members rotating in contact with the photosensitive member and the photosensitive member before the photosensitive member starts to be rotated. By applying the reversed bias voltage, charges are filled onto the contaminated portion of the photosensitive member, thus suppressing the appearance of a hollow white printed part on the half tone image.

Furthermore, in the configuration of the image forming apparatus and the process cartridge of the present invention, when the image forming operation starts from a standstill, the members rotating in contact with the photosensitive member, for example, a charging roller, a developing roller, a cleaning roller, and the like, are rotated before the photosensitive member starts to be rotated while leaving the photosensitive member at a standstill. Moreover, in the configuration, while the members rotating in contact with the photosensitive member are rotated before the photosensitive member (before the photosensitive member starts to be rotated), a reversed bias voltage that is opposite the usual voltage at development time is applied between the members rotating in contact with the photosensitive member and the photosensitive member. In the usual development time, a bias voltage is applied in the direction in which toner is attached to the photosensitive member. The reversed bias voltage herein denotes a bias voltage in the direction in which toner is attracted to the developing roller. When the members rotating in contact with the photosensitive member are rotated before the photosensitive member starts to be rotated, by applying the reversed bias voltage, it is possible to obtain the effect of preventing toner from scattering and of attracting the contaminants. This effect is exhibited significantly in the developing roller on the surface of which toner is present in a form of a thin film.

Also in this case, it is desirable that the time in which each roller rotating in contact with the photosensitive member is rotated before the photosensitive member starts to be rotated, i.e., the time in which the reversed bias voltage that is opposite the usual voltage at development time before the photosensitive member starts to be rotated is 0.01–2.0 seconds.

It is desirable that the absolute value of the reversed bias voltage is 5–300 V, more desirably 50–200 V. If the value is less than 5V, it is not possible to suppress the scattering of toner sufficiently; and if the value is more than 300V, the contamination to rollers due to toner is increased, thus shortening the lifetime of the rollers.

As mentioned above, by rotating members in contact with the photosensitive member (i.e. contamination source) in advance to the photosensitive roller, or by applying the reversed bias voltage that is an opposite voltage to that at usual development time between the member rotating in contact with the photosensitive member and the photosensitive member, before the photosensitive member starts to be rotated, it is possible to suppress the appearance of hollow white parts due to the contamination of the photosensitive member. However, when the number of pages printed is increased and accordingly the toner is deteriorated, the deteriorated toner is attached to the portion on the photosensitive member in which the reversed bias voltage is applied, and thus black lines are generated.

In order to avoid such black lines, it is desirable that the time of applying the reversed bias voltage is changed in accordance with the number of pages printed. That is, it is desirable that each time the number of pages printed reaches the predetermined number, the time for applying the reversed bias voltage is reduced.

Since black toner contains a carbon pigment, it has different characteristics from cyan toner, magenta toner, and the yellow toner (i.e., color toner). Therefore, it is desirable that the changing degree of the time for applying the reversed bias voltage is varied in accordance with whether the toner is black toner or color toner.

The same effect can be obtained by changing the time in which the members rotating in contact with the photosensitive member is rotated before the photosensitive member starts to be rotated in accordance with the number of the printed paper (i.e., by reducing the time in which the members rotating in contact with the photosensitive member is rotated before the photosensitive member starts to be rotated, each time the number of pages printed reaches the predetermined number). Also in this case, it is desirable that the changing degree of the time in which the members rotating in contact with the photosensitive member are rotated in advance to the photosensitive member starts to be rotated is varied in accordance with whether the toner is black toner or color toner.

Table 1 shows the relationship between the number of pages printed (in sheet) and the time in which the reversed bias voltage is applied (or the time in which the members rotating in contact with the photosensitive member are rotated before the photosensitive member starts to be rotated). In Table 1, Bk, Y, M, and C denote black, yellow, magenta and cyan, respectively.

TABLE 1

| | 0–999 (in sheet) | 1000–1499 (in sheet) | 1500–1999 (in sheet) | 2000–4999 (in sheet) | 5000–10000 (in sheet) |
|---|---|---|---|---|---|
| Bk* | 1.0–0.25 | 0.2–0.1 | 0.05–0.01 | 0.05–0.01 | 0.05–0.01 |
| Y, M, C* | 2.0–0.7 | 0.65–0.55 | 0.5–0.4 | 0.35–0.1 | 0.35–0.1 |

*in second

Furthermore, the same effect can be obtained also by changing the amount of the reversed bias voltage in accordance with the number of pages printed (i.e., by reducing the reversed bias voltage each time the number of the printed paper reaches a predetermined number). Also in this case, it is desirable to change the changing degree of the reversed bias voltage in accordance with whether for the black toner or for the color toner.

Table 2 shows the relationship between the number of pages printed and the amount of the reversed bias voltage when the application time of the reversed bias voltage is set to be 0.5 seconds.

TABLE 2

| | 0–999 (in sheet) | 1000–1499 (in sheet) | 1500–1999 (in sheet) | 2000–4999 (in sheet) | 5000–10000 (in sheet) |
|---|---|---|---|---|---|
| Bk | 150–110V | 100–60V | 50–5V | 50–5V | 50–5V |
| Y, M, C | 300–250V | 200–150V | 100–60V | 50–5V | 50–5V |

Furthermore, the image forming apparatus and process cartridge of the present invention include a photosensitive member, members rotating in contact with the photosensitive member, and a member for removing electricity. The members rotating in contact with the photosensitive member are rotated before the photosensitive member starts to be rotated when the image forming operation starts from a standstill, and while the members rotating in contact with the photosensitive member are rotating before the photosensitive member starts to be rotated, a reversed bias voltage that is opposite the usual voltage at development time. The member for removing electricity removes electricity on the photosensitive member after transfer.

The contamination of the photosensitive member is dependent upon how long the members such as a charging roller, a developing roller, a transfer roller, a cleaning roller, and the like, which rotate in contact with the photosensitive member are in contact with the photosensitive member. However, in a case where the reversed bias voltage that is opposite to the usual development time is applied to the member rotating in contact with the photosensitive member, the contamination may produce black lines on the white part of a recording paper. This state mainly is observed in the end life of the black toner. This is thought to occur because the excess charges are filled onto the photosensitive member due to the reversed bias voltage that is applied for the purpose of the anti-contamination measurement. In the present invention, since the member for removing electricity from the photosensitive member after transfer is present, charges filled onto the photosensitive member in excess can be removed.

For the member for removing electricity, one in which a conductive sheet is brought into contact with the photosensitive member can be used. Moreover, a cleaning member may be provided with an effect for removing electricity.

For the charging roller of the present invention, a conductive elastic product of silicone rubber, urethane rubber, or the like, or the foam thereof, a multi-layer structured product including an inner elastic layer provided with a surface layer such as a conductive layer, an insulating layer, or the like, can be used. From the viewpoint of charging stability, it is desirable to use one made of urethane rubber.

For the developing roller of the present invention, it is possible to use one made of rubber with elasticity, such as silicone rubber or urethane rubber. However, from the viewpoint of the image quality, it is desirable to use one made of silicone rubber.

The photosensitive member of the present invention includes any types of photosensitive members, for example, organic photosensitive member, inorganic photosensitive member, etc, which have a surface that is susceptible to contamination.

The following is a detailed explanation of the present invention with reference to the preferred embodiments.

First Embodiment

FIG. 1 is a cross-sectional view showing a process cartridge in a first embodiment according to the present invention. In FIG. 1, reference numeral 17 denotes a process cartridge unit, which has the following component members. Reference numeral 53 denotes a developing roller made of silicone rubber having a low hardness (43 degrees in accordance with JIS-A as an index showing hardness) and having a diameter of 18 mm and a thickness of 4 mm. This developing roller 53 has a resistance of $10^4\Omega$ and a surface roughness (Rz) of 1.5 $\mu$m and is rotated at the peripheral speed of 170 mm/sec in the arrow direction. Reference numeral 51 denotes a developing blade made of stainless plate (SUS 303, 304, etc.) having a thickness of 150 $\mu$m. Reference numeral 52 denotes a feeding roller made of urethane foam. The feeding roller 52 feeds toner 59 to the developing roller 53. This feeding roller 52 has a diameter of 12.5 mm and is rotated at the peripheral speed of 98 mm/sec in the arrow direction. Reference numeral 11 denotes a laminated organic photosensitive member based on phthalocyanine, having a diameter of 30 mm, which is rotated at the peripheral speed of 105 mm/sec in the arrow direction by a photosensitive member driving unit 60. Reference numeral 55 denotes a cleaning blade made of an urethane material for cleaning off toner remaining on the surface of the photosensitive member after transfer.

Reference numeral 57 denotes a charging roller made of urethane rubber for charging the photosensitive member 11 to have a negative potential. This charging roller 57 is rotated in the arrow direction by the charging roller driving unit 61. Reference numeral 56 denotes waste toner scraped off by the cleaning blade 55, and 58 denotes a laser exposure signal.

The toner 59 used is a black non-magnetic one-component toner obtained by adding 0.5 wt % of hydrophobic silica as a surface modifier into 99.5 wt % of non-magnetic toner base particles having an average particle size of 8.5 $\mu$m. The non-magnetic toner base particles are obtained by pulverizing and classifying 92 wt % of polyester resin in which 5 wt % of pigment such as a carbon pigment and 3 wt % of a charge control agent are kneaded and dispersed.

The photosensitive member 11 is connected to the photosensitive member driving unit 60 via gears. The rotation of the photosensitive member driving unit 60 is controlled by the controlling unit 150. The developing roller 53 is connected to the developing roller bias power source 151. The controlling unit 150 controls the developing roller bias power source 151 , and appropriate voltage is applied to the developing roller 53 by the developing roller bias power source 151. The charging roller 57 is connected to the charging roller driving unit 61 via gears. The charging roller driving unit 61 is controlled to be rotated before the photosensitive member 11 starts to be rotated. The controlling unit 150 controls the charging roller bias power source 152. The charging roller 57 is connected to the charging roller bias power source 152. A reversed bias voltage that is a voltage opposite to the bias voltage at usual development time is applied to the charging roller 57 by the charging roller bias power source 152 before the photosensitive member 11 starts to be rotated, and thereafter a usual bias voltage is applied to the charging roller 57.

The following is an explanation of the image forming process. First, the charging roller 57 is rotated by the charging roller driving unit 61, whereby contaminants on the photosensitive member 11 are removed. In this embodiment, the time in which the charging roller 57 is rotating before the photosensitive member 11 starts to be rotated is set to be 0.5 seconds. Next, the photosensitive member 11 starts to be rotated by the photosensitive member driving unit 60, and at the same time, the photosensitive roller 11 is charged to −600V by the charging roller 57. Then, the exposure signal 58 enters the process cartridge 17, and an electrostatic latent image is formed on the photosensitive member 11. The toner 59 is fed to the developing roller 53 by the feeding roller 52, and the toner 59 provided on the developing roller 53 is formed into a thin film by the developing blade 51. Then, a developing bias of −400V DC voltage is applied to the developing roller 53 facing in contact with the photosensitive member 11 and rotating in the direction opposite to that of the photosensitive member 11. Thereby, the latent image is developed so as to become a manifest image.

The toner image on the photosensitive member 11 is transferred onto the recording paper (not shown). The toner remaining on the photosensitive member 11 is scraped off by the cleaning blade 55 to be waste toner 56.

Moreover, in this embodiment, a process cartridge unit using other conventionally known developing methods may be used.

Furthermore, in this embodiment, the time for which the charging roller 57 is rotating before the photosensitive member 11 starts to be rotated is set to be 0.5 seconds (constant). However it is desirable that the time is reduced each time the number of pages printed reaches the predetermined number. Specifically, when the number of pages printed is 0–999, the time is set to be 0.3 seconds; when the number is 1000–1499, the time is set to be 0.1 seconds; and when the number is 1500–10000, the time is set to be 0.05 seconds.

Furthermore, in this embodiment, the apparatus using a single toner 59 is described. However, by using toner of four colors, this embodiment can be applied to a color printer.

Figure 3:
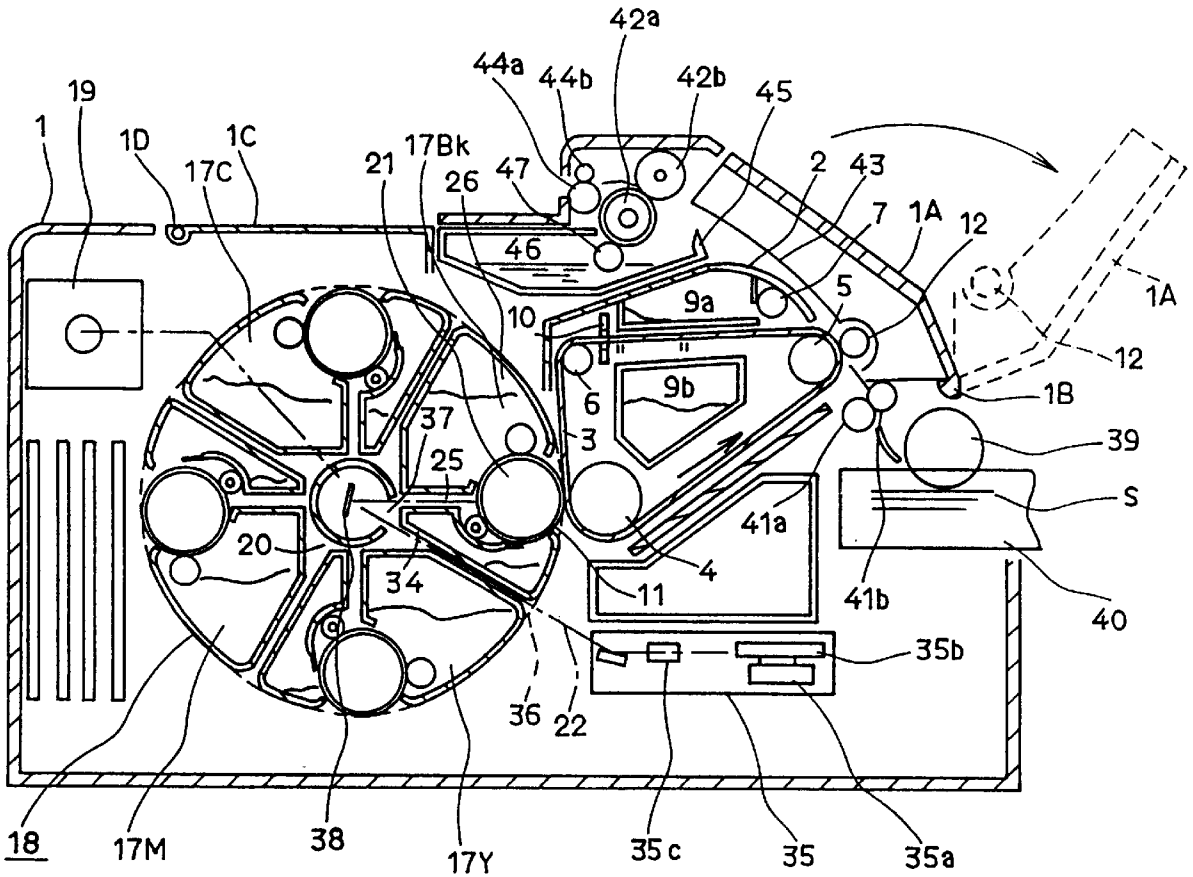
FIG. 3 is a cross-sectional view showing an image forming apparatus for forming a full color image in the first embodiment according to the present invention.

FIG. 3 is a cross-sectional view showing an image forming apparatus for forming a full color image in this embodiment. In FIG. 3, reference numeral 1 denotes an outer printer housing for a color electrophotographic printer that is an image forming apparatus, with the right-hand face being the front face of the apparatus. Reference numeral 1A denotes a printer front plate. The printer front plate 1A is hinged on a hinge axis 1B on the lower side of the outer printer housing 1, and freely can be lowered and opened towards the front as shown by the broken line, and raised and closed as shown by the solid line. For the attachment/detachment of the intermediate transfer belt unit in the printer, inspection, maintenance of the printer internal parts, for example, the removal of paper jams, or the like, the printer front plate 1A is lowered and opened, and the internal parts of the printer are laid open. The direction in which the intermediate transfer belt unit 2 is attached/detached is designed so as to be perpendicular to the direction of a main line axis of the photosensitive member 11.

Figure 4:
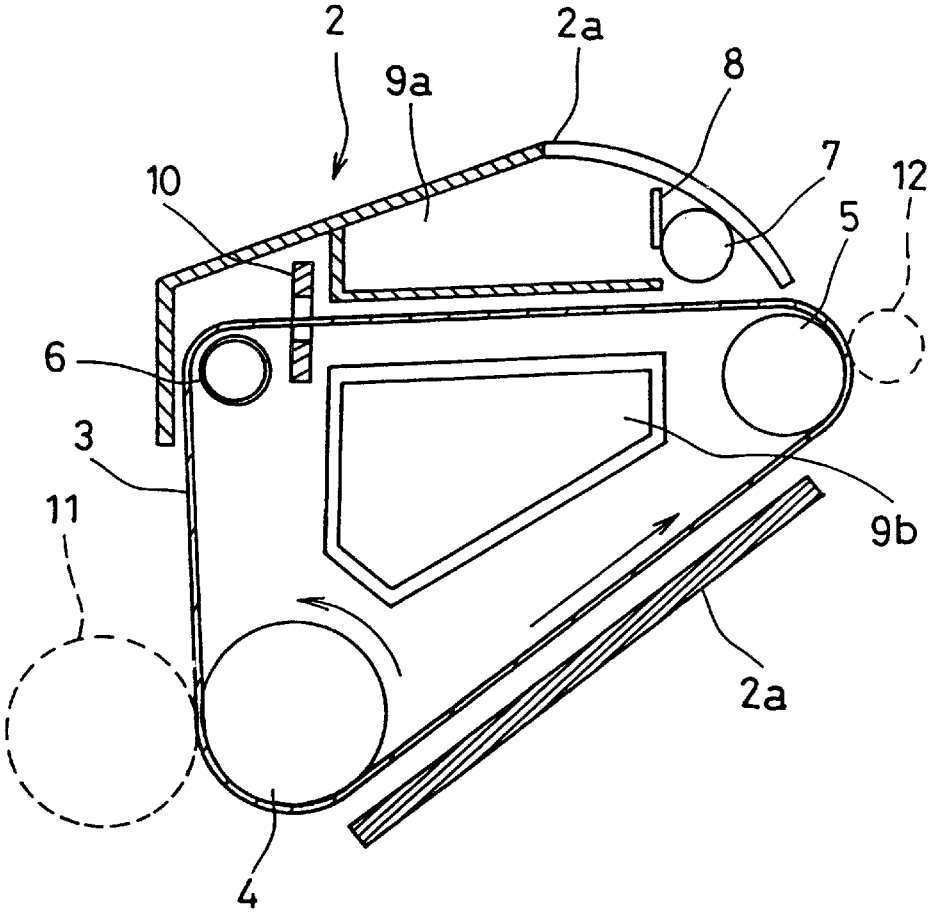
FIG. 4 is a cross-sectional view showing an intermediate transfer belt unit in the first embodiment according to the present invention.

FIG. 4 is a cross-sectional view showing a configuration of the intermediate transfer belt unit. The intermediate transfer belt unit 2 includes an intermediate transfer belt 3; a group of rollers to which the intermediate transfer belt 3 is suspended with tension, that is, a first transfer roller 4 made of a conductive elastic member, a second transfer roller 5 made of aluminum, and a tension roller 6 for adjusting the tension of the intermediate transfer belt 3; a belt cleaner roller 7 for cleaning off toner remained on the intermediate transfer belt unit 3; a scraper 8 for scraping off the toner collected on the cleaner roller 7; waste toner reservoirs 9*a*, 9*b* for containing the collected toner; and a position detector 10 for detecting the position of the intermediate transfer belt 3. The above-mentioned component members are housed in a unit housing 2*a*.

The intermediate transfer belt 3 is obtained by kneading conductive filler in insulating resin to form a film through an extruder. In this embodiment, 5 parts by weight of conductive carbon (e.g., Ketchen Black (Trade Name), produced by AKZO Co.) as a conductive filler were added to 95 parts by weight of polycarbonate resin (e.g., Yupiron Z300 produced by Mitsubishi Gas Chemical Co., Inc.) as insulating resin to form a film. The resultant film was coated with fluororesin. The thickness of the film is about 350 $\mu$m and the specific resistance thereof is about $10^7$ to $10^8$ Ω·cm. The reason why the film obtained by kneading a conductive filler in polycarbonate resin was used herein is to prevent effectively the transfer belt 3 from sagging after a long period of use or to prevent electric charges from accumulating. Furthermore, the reason why the surface was coated with fluororesin is to prevent effectively the toner from filming on the surface of the intermediate transfer belt 3 after a long period of use.

The intermediate transfer belt 3 is suspended onto the first transfer roller 4, the second transfer roller 5, and the tension roller 6, so as to be movable in the arrow direction. The first transfer roller 4 is made of an endless belt-shaped film, having a thickness of 100 $\mu$m, containing semiconductive urethane as its base member, and the outer periphery thereof is made of urethane foam subjected to low resistance processing so as to have a specific resistance of $10^7$ Ω·cm. The peripheral length of the intermediate transfer belt 3 is set to be 360 mm, which corresponds to a total of a longitudinal length (298 mm) of an A4 sheet (longest sheet size) and a length (62 mm) slightly longer than half of a peripheral length of the photosensitive member 11 (diameter: 30 mm).

When the intermediate transfer belt unit 2 is attached to the printer main body, the first transfer roller 4 is pressed onto a photosensitive member 11 by a force of about 1.0 kgf through the intermediate transfer belt 3. The second transfer roller 5 is pressed onto a third transfer roller 12 having the same configuration as that of the first transfer roller 4 through the intermediate transfer belt 3. The third transfer roller 12 is formed so as to be rotated in accordance with the movement of the intermediate transfer belt 3.

The cleaner roller 7 is a roller in a belt cleaner portion for cleaning off the intermediate transfer belt 3. The cleaner roller 7 has a structure in which an AC voltage for electrostatically attracting toner 59 is applied to a metallic roller. The cleaner roller may be a rubber blade or a conductive fur brush with a voltage applied thereto.

As shown in FIG. 3, four sectors, i.e., process cartridge units 17Bk, 17Y, 17M, and 17C for black, yellow, magenta, and cyan are arranged in a circular shape in the middle of the printer to form a process cartridge unit group 18. Each of the process cartridge units 17Bk, 17Y, 17M and 17C, can be attached to or detached from the predetermined position of the process cartridge unit group 18 by opening a printer upper surface plate 1C around a hinge axis 1D. When the process cartridge units 17Bk, 17Y, 17M and 17C are correctly attached to the printer, a mechanical driving system and an electric circuit system of the process cartridge unit side are combined with those on the printer side through a mutual coupling member (not shown), whereby the process cartridge units 17Bk, 17Y, 17M and 17C are mechanically and electrically integrated with the printer.

In the image forming apparatus of this embodiment, a photosensitive member driving unit 60 and a charging roller driving unit 61 are provided separately. And the photosensitive member 11 and the charging roller 57 can operate independently.

The process cartridge units 17Bk, 17Y, 17M, and 17C arranged in a circular shape are supported by a supporter (not shown). The process cartridge units 17Bk, 17Y, 17M, and 17C are driven as a unit when the supporter is driven to move by a drive motor 19, and can be rotated around a cylindrical axis 20 that is fixed so as not to be rotated. Each process cartridge unit 17Bk, 17Y, 17M, and 17C can be positioned at an image forming position 21 successively by the rotation. The image forming position 21 is a portion facing the second transfer roller 4, suspending onto the intermediate transfer belt 3 and also a position for exposure to a pixel laser signal light 22.

Each process cartridge unit 17Bk, 17Y, 17M, and 17C is composed of the same structural member except for a developer therein. Therefore, for simplicity, only the process cartridge unit 17Bk for black will be described, and the explanation of the other units 17Y, 17M, and 17C will be omitted.

In FIG. 3, reference numeral 35 denotes a laser beam scanner portion provided on a lower side of the outer housing 1. The laser beam scanner portion 35 includes a semiconductor laser (not shown), a scanner motor 35*a*, a polygon mirror 35*b*, a lens system 35*c*, and the like. The pixel laser signal light 22 corresponding to a time-series electrical pixel signal of image information from the laser beam scanner portion 35 passes through a light path window 36 formed between the process cartridge units 17Bk and 17Y. Then, the pixel laser signal light 22 passes through a window 37 which is a partial opening of an axis 20. The pixel laser signal light 22 is incident upon a mirror 38 fixed in the axis 20. The pixel laser signal light 22 that is reflected from the mirror 38 enters the process cartridge unit 17Bk in a substantially horizontal direction through an exposure window 25 of the process cartridge unit 17Bk, which is positioned at the image forming position 21. Then, the pixel laser signal light 22 passes through a light path between a developing agent reservoir 26 and a cleaner 34 provided in an up-and-down direction in the process cartridge unit 17Bk, is incident upon an exposure portion on a left side of the photosensitive member 11 and exposes the photosensitive member 11 to light by scanning in a main line direction.

As the light path from the light path window 36 to the mirror 38, a gap between the adjacent sides of the process cartridge units 17Bk and 17Y is utilized. Therefore, there is almost no dead space in the process cartridge unit group 18. Furthermore, since the mirror 38 is provided in the middle of the process cartridge unit group 18, the mirror 38 can be composed of a single fixed mirror. Thus, the positioning can be performed easily with a simple configuration.

Reference numeral 12 denotes a third transfer roller provided on an inner side of the printer front plate 1A and in an upper part of a paper supply roller 39. In a nip portion where the intermediate transfer belt 3 is pressed onto the third transfer roller 12, a paper transportation path is formed so that paper is transported from the paper supply roller 39 provided in a lower part of the printer front plate 1A.

Reference numeral 40 denotes a paper supply cassette provided on a lower end side of the printer front plate 1A so as to protrude outward. A plurality of paper sheets S can be set simultaneously in the paper supply cassette 40.

Reference numerals 41*a* and 41*b* denote paper conveying timing rollers; 42*a*, 42*b* denote a fixing roller pair provided in an upper part in the printer; 43 denotes a paper guide plate provided between the third transfer roller 12 and the fixing roller pair 42*a*, 42*b*; 44*a*, 44*b* denote a paper discharge roller pair provided on a paper exit side of the fixing roller pair 42*a*, 42*b*; 45 denotes a fixing oil reservoir for storing silicone oil 46 to be supplied to the fixing roller 42*a*; and 47 denotes an oil supply roller for coating the fixing roller 42*a* with the silicone oil 46.

Each process cartridge unit 17Bk, 17Y, 17M, and 17C, and the intermediate transfer belt unit 2 is provided with a waste toner reservoir.

The following is an explanation of the operation.

First, the process cartridge unit group 18 is in a position shown in FIG. 3, and the process cartridge unit 17Bk for black is positioned at the image forming position 21. At this time, the photosensitive member 11 is pressed onto the first transfer roller 4 via the intermediate transfer belt 3.

In the image forming step, the pixel laser signal light 22 for black is input from the laser beam scanner portion 35 to the process cartridge unit 17Bk, whereby an image is formed with black toner. At this time, an image forming speed of the image forming unit 17Bk (60 mm/sec equal to a peripheral speed of the photosensitive member 11) is set so as to be equal to a moving speed of the intermediate transfer belt 3. At the same time as an image is formed by a black toner, the black toner is transferred to the intermediate transfer belt 3 by the function of the first transfer roller 4. Also, at this time, a DC voltage of +1 kV is applied to the first transfer roller 4. Immediately after a black toner image is completely transferred to the intermediate transfer belt 3, the process cartridge units 17Bk, 17Y, 17M, and 17C, as a process cartridge unit group 18, are driven as a unit by the drive motor 19 to be rotated in the arrow direction in FIG. 3. When the process cartridge unit group 18 is rotated by 90°, and the process cartridge unit 17Y reaches the image forming position 21, the process cartridge unit group 18 is stopped. During this time, the components of the process cartridge unit other than the photosensitive member 11, such as the developing agent reservoir 26 or the cleaner 34, are positioned on an inner side of a rotation arc of an end of the photosensitive member 11. Therefore, the intermediate transfer belt 3 will not come into contact with the process cartridge unit.

After the process cartridge unit 17Y reaches the image forming position 21, the laser beam scanner portion 35 inputs the pixel laser signal light 22 to the process cartridge unit 17Y for yellow in the same way as the above, whereby a yellow toner image is formed and transferred. By this time, the intermediate transfer belt 3 makes a cycle, and write timing of the pixel laser signal light 22 for yellow is controlled so that a yellow toner image is aligned with the previously transferred black toner image. During this time, the third transfer roller 12 and the cleaner roller 7 are slightly away from the intermediate transfer belt 3 so as not to disturb a toner image on the intermediate transfer belt 3.

The same operation as described above is performed for magenta and cyan, and a color image is formed on the intermediate transfer belt 3, in which toner images of four colors are overlapped at the same position with each other. After the last cyan toner image is transferred onto the intermediate transfer belt 3, toner images of four colors are transferred at the same timing to the paper conveyed from the paper supply cassette 40 by the function of the third transfer roller 12. At this time, the second transfer roller 5 is grounded, and a DC voltage of +1.5 kV is applied to the third transfer roller 12. A toner image transferred to the paper is fixed by the fixing roller pair 42*a*, 42*b*. The paper is output from the apparatus through the discharge roller pair 44*a*, 44*b*. Toner remaining on the intermediate transfer belt 3 after transfer is cleaned off by the cleaner roller 7 and the transfer belt 3 becomes ready for formation of the subsequent image.

When the apparatus is used for a color printer, it is desirable to reduce the time in which the charging roller 57 is rotated before the photosensitive member 11 starts to be rotated each time the number of pages printed reaches the predetermined number. Furthermore, it is desirable to change the changing degree of time in which the charging roller 57 is rotated before the photosensitive member 11 starts to be rotated in accordance with whether the toner is black toner or cyan toner, magenta toner and yellow toner (i.e., color toner). Specifically, for black toner, when the number of pages printed is 0–999, the time is set to be 0.3 seconds, when the number is 1000–1499, the time is set to be 0.1 seconds, and when the number is 1500–10000, the time is set to be 0.05 seconds. For color toner, when the number of pages printed is 0–999, the time is set to be 0.75 seconds, when the number is 1000–1499, the time is 0.6 seconds, when the number is 1500–1999, the time is set to be 0.45 seconds, and the number is 2000–10000, the time is set to be 0.3 seconds.

Next, an operation during a monochromatic mode will be described.

During a monochromatic mode, first, a process cartridge unit for a predetermined color is moved to the image forming position 21. Then, an image of the predetermined color is formed and transferred to the intermediate transfer belt 3 in the same way as the above. Thereafter, in this case, the image on the intermediate transfer belt 3 is transferred to paper conveyed from the paper supply cassette 40 by the third transfer roller 12 as it is while process cartridge unit group 18 is not rotated and then fixed thereon as it is by the fixing roller pair 42*a*, 42*b*.

The process cartridge of this embodiment was evaluated by using the above-mentioned image forming apparatus.

After the process cartridge was left for one month so that the photosensitive member 11 is subjected to contamination, the image was formed by the above-mentioned method. The formed image was a good image on which no contamination of the photosensitive member remained. Furthermore, when the running was carried out for 10,000 sheets of paper, good images also could be obtained.

Second Embodiment

Figure 2:
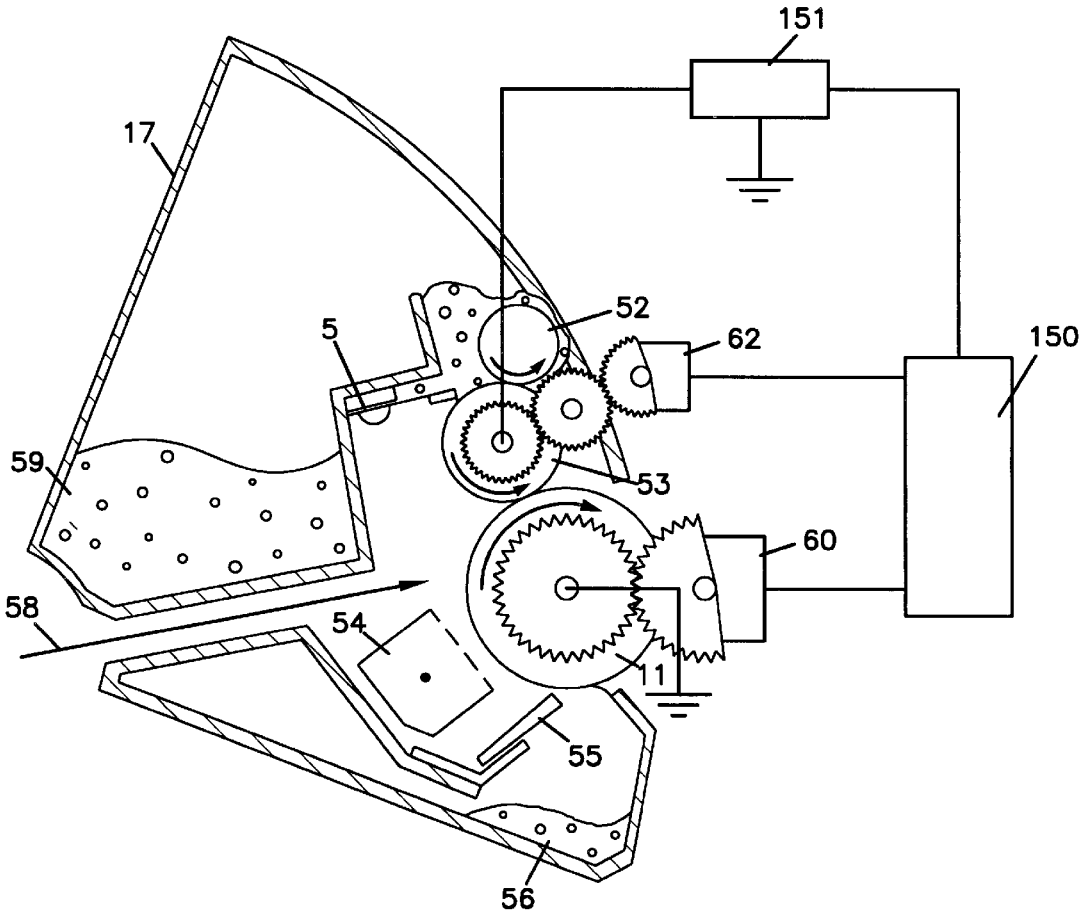
FIG. 2 is a cross-sectional view showing a process cartridge in a second embodiment according to the present invention.

FIG. 2 is a cross-sectional view showing a process cartridge in a second embodiment according to the present invention. In FIG. 2, reference numeral 62 denotes a developing roller driving unit, and 54 denotes a corona charger for charging the photosensitive member 11 to have a negative potential. Other configurations are the same as in the above-mentioned first embodiment.

The following is an explanation of the color image forming process. First, the photosensitive member 11 is charged to −600V by the corona charger 54. Next, an exposure signal 58 enters the process cartridge 17 and an electrostatic latent image is formed on the photosensitive member 11. Toner 59 is fed onto the developing roller 53 by the feeding roller 52. The toner 59 supplied onto the developing roller 53 is formed into a thin film by the developing blade 51. Next, a developing bias of DC voltage of −400 V is applied to the developing roller 53 that is in contact with and facing the photosensitive member 11 and is rotated in the same direction, whereby the latent image is developed to become a manifest image. At this time, usually, the developing roller 53 and the photosensitive member 11 starts to be rotated simultaneously. However, the image forming apparatus of this embodiment is designed so that the developing roller 53 starts to be rotated by the developing roller driving unit 62 before the photosensitive member 11 starts to be rotated. Thereby, the developing roller 53 scrapes off the portion in which the developing roller 53 is in contact with the photosensitive roller 11 to remove the contaminants on the photosensitive member 11, then the photosensitive member 11 starts to be rotated by a photosensitive member driving unit 60. In this embodiment, the time in which the developing roller 53 is rotated before the photosensitive member 11 starts to be rotated is set to be 0.8 seconds.

The photosensitive member 11 is connected to the photosensitive member driving unit 60 via gears. The rotation of the photosensitive member driving unit 60 is controlled by the controlling unit 150. The developing roller 53 is connected to the developing roller driving unit 62 via gears. The developing roller driving unit 62 is controlled to be rotated before the rotation of the photosensitive member 11 starts to be rotated. The developing roller 53 is connected to the developing roller bias power source 151 . A reversed bias voltage that is a voltage opposite to the bias voltage at usual development time is applied to the developing roller 53 by the developing roller bias power source 151 before the photosensitive member 11 starts to be rotated, and thereafter a usual bias voltage is applied to the developing roller 53.

In this embodiment, it is also possible to use a process cartridge unit having a configuration using the other conventionally known developing method.

Furthermore, in this embodiment, the apparatus using a single toner 59 is described. However, by using toner of four colors, the apparatus can be used for a color printer as it is.

Also in this embodiment, the process cartridge 17 was evaluated similarly to the above-mentioned first embodiment.

After the process cartridge was left for one month so as to allow the photosensitive member 11 to be contaminated, the image was formed by the above-mentioned method. The resultant formed image was a good image on which no contamination of the photosensitive member remained on the formed image. Furthermore, when the running was carried out for 10000 sheets of paper, good images also could be obtained.

Third Embodiment

In this embodiment, without rotating the developing roller 53 before the photosensitive member 11 starts to be rotated, a reversed bias voltage of +100V, which is an opposite voltage to the usual voltage at development time was applied between the developing roller 53, which is a member rotating in contact with the photosensitive member 11, and the photosensitive roller 11, 0.5 seconds before the photosensitive member 11 starts to rotate. The other configuration is the same as the above-mentioned second embodiment.

In this embodiment, the time in which the reversed bias voltage is applied is set to be 0.5 seconds (constant). However, it is desirable to reduce the time in which the reversed bias voltage is applied, each time the number of pages printed reaches the predetermined number. This is because the increase of the printed number causes toner to be deteriorated, and the deteriorated toner is attached to the portion on the photosensitive member 11 in which the reversed bias voltage is applied, thus generating black lines. Specifically, when the number of pages printed is 0–999, the time is set to be 0.3 seconds; when the number is 1000–1499, the time is set to be 0.1 seconds; and when the number is 1500–10000, the time is set to be 0.05 seconds. Furthermore, the same effect can be obtained by reducing the amount of the reversed bias voltage each time the number of pages printed reaches the predetermined number. Specifically, in a case where the application time of the reversed bias voltage is set to be 0.5 seconds, when the number of pages printed is 0–999, the reversed bias voltage is set to be 150V; when the number is 1000–1499, the voltage is set to be 100V; and when the number is 1500–10000, the voltage is set to be 50V.

Furthermore, when the image forming apparatus of the present invention is used as a color printer, it is desirable that the varying degree of the reversed bias voltage applying time is changed in accordance with whether the toner is black toner or color toner. Specifically, for black toner, when the number of pages printed is 0–999, the time is set to be 0.3 seconds; when the number is 1000–1499, the time is set to be 0.1 seconds; and when the number is 1500–10000, the time is set to be 0.05 seconds. For color toner, when the number of pages printed is 0–999, the time is set to be 0.75 seconds; when the number is 1000–1499, the time is set to be 0.6 seconds; when the number is 1500–1999, the time is set to be 0.45; and when the number is 2000–10000, the time is set to be 0.3 seconds. Furthermore, the same effect can be obtained by varying the changing degree of the opposite bias voltage. Specifically, when the application time of the bias voltage is set to be 0.5 seconds, for the black toner, when the number of pages printed is 0–999, the reversed bias voltage is set to be 150V; when the number is 1000–1499, the reversed bias voltage is set to be 100V; and when the number is 1500–10000, the bias voltage is set to be 50V. For color toner, when the number of pages printed is 0–999, the reversed bias voltage is set to be 300V; when the number is 1000–1499, the reversed bias voltage is set to be 200V; when the number is 1500–1999, the reversed bias voltage is set to be 100V; and when the number is 2000–10000, the reversed bias voltage is set to be 50V.

The process cartridge 17 of this embodiment was also evaluated similarly to the above-mentioned first embodiment.

After the process cartridge was left for one month so that the photosensitive member 11 is subjected to contamination, the image was formed by the above-mentioned method. The formed image was a good image on which no contamination of the photosensitive member is remained. Furthermore, when the running was carried out for 10000 sheets of paper, good images also could be obtained.

Fourth Embodiment

In this embodiment, while the developing roller 53 is rotating before the photosensitive member 11 starts to be rotated, a reversed bias voltage of +100V that is an opposite voltage to the usual voltage at development time was applied between the developing roller 53, which is a member rotating in contact with the photosensitive member 11, and the photosensitive roller 11. Furthermore, the time while the developing roller 53 is rotating before the photosensitive member 11 starts to be rotated is set to be 1.0 second. The other configuration is the same as the above-mentioned second embodiment.

Also in this embodiment, the process cartridge 17 was evaluated by the same method as in the above-mentioned first embodiment.

After the process cartridge was left for one month so that the photosensitive member 11 is subjected to contamination, the image was formed by the above-mentioned method. The formed image was a good image on which no contamination of the photosensitive member remained. Furthermore, when the running was carried out for 10000 sheets of paper, good images also could be obtained.

Fifth Embodiment

In this embodiment, as the cleaning blade 55, a urethane rubber to which a conductive material is added to be provided with conductivity was used. The other configuration is the same as the above-mentioned fourth embodiment.

Also in this embodiment, the process cartridge 17 was evaluated by the same method as in the above-mentioned first embodiment.

After the process cartridge was left for one month so that the photosensitive member 11 is subjected to contamination, the image was formed by the above-mentioned method. The formed image was a good image on which no contamination of the photosensitive member remained. Furthermore, at the end of the life of the cartridge, white lines or black lines are not generated on the recording paper.

Sixth Embodiment

Figure 5:
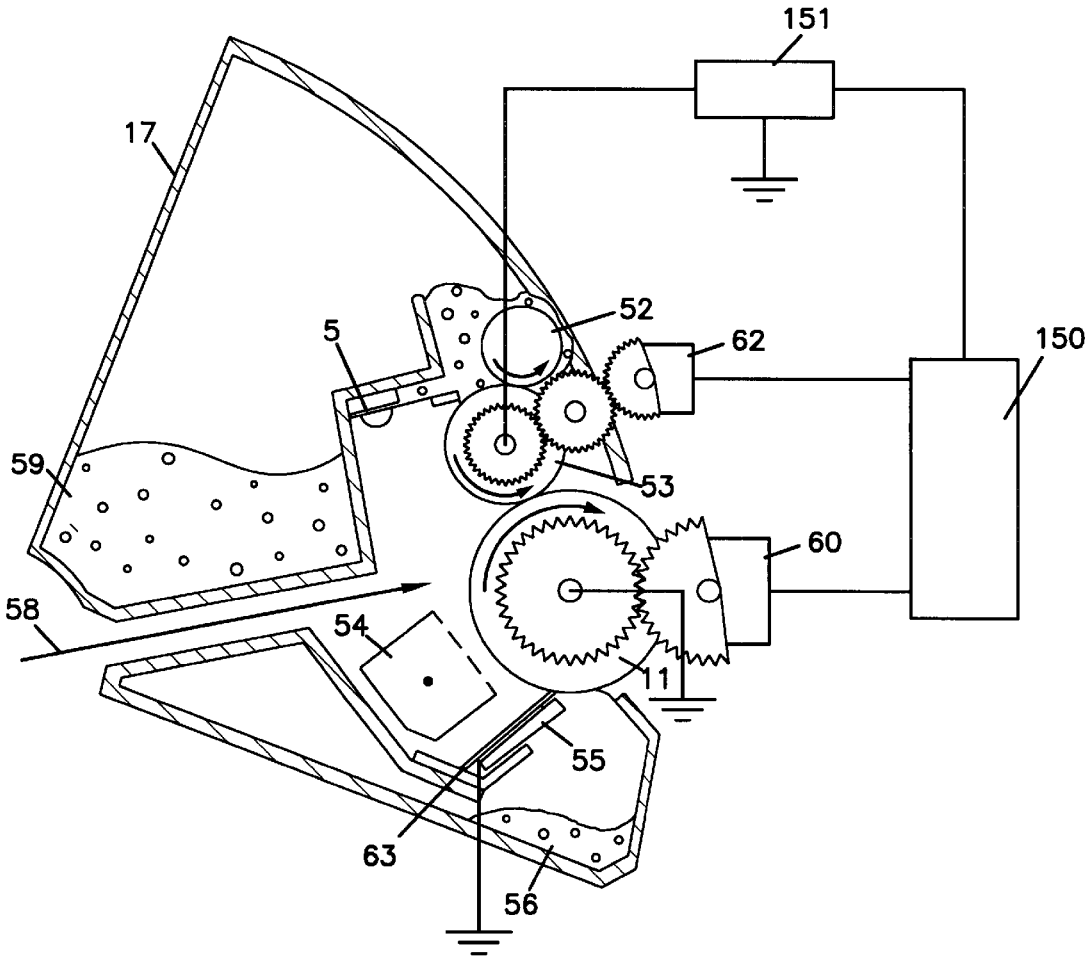
FIG. 5 is a cross-sectional view showing a configuration of a process cartridge in a sixth embodiment according to the present invention.

FIG. 5 is a cross-sectional view showing a process cartridge of a sixth embodiment according to the present invention. As shown in FIG. 5, at the downstream of the cleaning blade 55, a conductive sheet 63, which is a member for removing electricity, is provided in contact with the photosensitive member 11. Thereby, the electricity can be removed from the photosensitive member 11 after transfer. The other configuration is the same as the above-mentioned fourth embodiment.

The photosensitive member 11 is connected to the photosensitive member driving unit 60 via gears. The rotation of the photosensitive member driving unit 60 is controlled by the controlling unit 150. The developing roller 53 is connected to the developing roller driving unit 62 via gears. The developing roller driving unit 62 is controlled to be rotated before the rotation of the photosensitive member 11 starts to be rotated. The developing roller 53 is connected to the developing roller bias power source 151. A reversed bias voltage that is a voltage opposite to the bias voltage at usual development time is applied to the developing roller 53 by the developing roller bias power source 151 before the photosensitive member 11 starts to be rotated, and thereafter a usual bias voltage is applied to the developing roller 53. At the downstream of the cleaning blade 55 in the rotatory direction of the photosensitive member 11, the conductive sheet 63, which is a member for removing electricity, is provided in contact with the photosensitive member 11. Thereby, the electricity can be removed from the photosensitive member 11 after transfer.

Also in this embodiment, the process cartridge 17 was evaluated by the same method as in the above-mentioned first embodiment.

After the process cartridge was left for one month so that the photosensitive member 11 is subjected to contamination, the image was formed by the above-mentioned method. The formed image was a good image on which no contamination of the photosensitive member remained. Furthermore, at the end of the life of the cartridge, black lines are not generated on the recording paper.

Comparative Example 1

The same evaluation as in the first embodiment was carried out by using the same process cartridge as the process cartridge 17 of the above-mentioned first embodiment except that the charging roller 57 is not rotated before the photosensitive member 11 starts to be rotated.

After the process cartridge was left for one month so that the photosensitive member 11 is subjected to contamination, the image was formed by the above-mentioned apparatus. The contamination of the photosensitive member was observed as high density lateral line on a contact print image, and as hollow white lateral line on a half-tone image.

Comparative Example 2

The same evaluation as in the first embodiment was carried out by using the same process cartridge as the process cartridge 17 of the above-mentioned second embodiment except that the developing roller 53 is not rotated before the photosensitive member 11 starts to be rotated.

After the process cartridge was left for one month so that the photosensitive member 11 is subjected to contamination, the image was formed by the above-mentioned apparatus. The contamination of the photosensitive member was observed as high density lateral line on a contact print image, and as hollow white lateral line on a half-tone image.

Comparative Example 3

The same evaluation as in the first embodiment was carried out by using the same process cartridge as the process cartridge 17 of the above-mentioned third embodiment except that the reversed bias voltage that is an opposite voltage to that usually used for development is not applied between the developing roller 53 that is a member rotating in contact with the photosensitive member 11 and the photosensitive member 11.

After the process cartridge was left for one month so that the photosensitive member 11 is subjected to contamination, the image was formed by the above-mentioned apparatus. The contamination of the photosensitive member was observed as high density lateral line on a contact print image, and as hollow white lateral line on a half-tone image.

Comparative Example 4

The same evaluation as in the first embodiment was carried out by using the same process cartridge as the process cartridge 17 of the above-mentioned fourth embodiment except that the time for which the developing roller 53 is rotating before the photosensitive member 11 starts to be rotated is set to be 3.0 seconds.

After the process cartridge was left for one month so as to allow the photosensitive member 11 to be contaminated, the image was formed by the above-mentioned apparatus. Due to the reversed bias voltage applied between the developing roller 53 and the photosensitive member 11, the remnant of charges filled into the photosensitive member 11 appeared as the highly concentrated lateral line also in the non-image forming portion. Furthermore, when the running was carried out for 4000 sheets, the surface of the developing roller 53 was worn out, and thus an excellent image was not able to be formed.

Comparative Example 5

The same evaluation as in the first embodiment was carried out by using the same process cartridge as the process cartridge 17 of the above-mentioned sixth embodiment except that the reversed bias voltage of +350V is applied between the developing roller 53 and the photosensitive member 11 and a member for removing electricity is not provided.

After the process cartridge was left for one month so as to allow the photosensitive member 11 to be contaminated, the image was formed by the above-mentioned apparatus. Due to the reversed bias voltage applied between the developing roller 53 and the photosensitive member 11, the remnant of charges filled into the photosensitive member 11 appeared as the highly concentrated lateral line also in the non-image forming portion.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An image forming apparatus comprising a photosensitive member and at least one member rotating in contact with said photosensitive member, wherein when an image forming operation starts from a standstill, said at least one member rotating in contact with said photosensitive member is controlled to be rotated a predetermined amount of time before said photosensitive member starts to be rotated.

2. The image forming apparatus according to claim 1, wherein a time for which said members rotating in contact with said photosensitive member are rotated before said photosensitive member starts to be rotated is 0.01–2.0 seconds.

3. The image forming apparatus according to claim 1, wherein the time for which said members rotating in contact with said photosensitive member are rotated before said photosensitive member starts to be rotated is changed in accordance with the number pages printed.

4. The image forming apparatus according to claim 3, wherein the time for which said members rotating in contact with said photosensitive member are rotated before said photosensitive member starts to be rotated is reduced each time the number of pages printed reaches the predetermined number.

5. The image forming apparatus according to claim 3, wherein the changing degree of the time for which said members rotating in contact with said photosensitive member before said photosensitive member starts to be rotated is varied in accordance with whether the toner (a) is black toner or (b) cyan toner, magenta toner, or yellow toner.

6. The image forming apparatus according to claim 1, wherein said members rotating in contact with said photosensitive member include a roller made of rubber and formed around an axis core, and wherein said rubber has a hardness of 30–80 degrees, a thickness of 0.5–7 mm, and a pressing force with respect to said photosensitive member of 0.5–1.2 kg.

7. The image forming apparatus according to claim 6, wherein said rubber has a hardness of 40–70 degrees and a thickness of 1–5 mm.

8. The image forming apparatus according to claim 1, wherein said members rotating in contact with said photosensitive member include a charging roller.

9. The image forming apparatus according to claim 8, wherein said charging roller is made of silicone rubber or urethane rubber.

10. The image forming apparatus according to claim 1, wherein said members rotating in contact with said photosensitive member include a developing roller.

11. The image forming apparatus according to claim 10, wherein said developing roller is made of silicone rubber or urethane rubber.

12. An image forming apparatus comprising a photosensitive member and at least one member rotating in contact with said photosensitive member, wherein before said photosensitive member starts to be rotated, a reversed bias voltage that is a voltage opposite to the bias voltage at usual development time is applied between said at least one member rotating in contact with said photosensitive member and said photosensitive member, and the application time of the reversed bias voltage is changed in accordance with the number of pages printed.

13. The image forming apparatus according to claim 12, wherein the application time of the reversed bias voltage is reduced each time the number of the pages printed reaches a predetermined number.

14. The image forming apparatus according to claim 12, wherein the changing degree of the application time of the reversed bias voltage is varied in accordance with whether the toner is (a) black toner or (b) cyan toner, magenta toner, or yellow toner.

15. An image forming apparatus comprising a photosensitive member and at least one member rotating in contact with said photosensitive member, wherein before said photosensitive member starts to be rotated, a reversed bias voltage that is a voltage opposite to the bias voltage at usual development time is applied between said at least one member rotating in contact with said photosensitive member and said photosensitive member, and the amount of reversed bias voltage is changed in accordance with the number of pages printed.

16. The image forming apparatus according to claim 15, wherein the amount of reversed bias voltage is reduced each time the number of pages printed reaches a predetermined number.

17. The image forming apparatus according to claim 15, wherein the changing degree of the reversed bias voltage is changed in accordance with whether the toner is (a) black toner or (b) cyan toner, magenta toner, or yellow toner.

18. An image forming apparatus comprising a photosensitive member and at least one member rotating in contact with said photosensitive member, wherein when an image forming operation starts from a standstill, said at least one member rotating in contact with said photosensitive member is controlled to be rotated a predetermined amount of time before said photosensitive member starts to be rotated, and while said at least one member rotating in contact with said photosensitive member is rotated before said photosensitive member starts to be rotated, a reversed bias voltage that is a voltage opposite to the bias voltage at usual development time is applied between said at least one member rotating in contact with said photosensitive member and said photosensitive member.

19. The image forming apparatus according to claim 18, further comprising a member for removing electricity, which is in contact with said photosensitive member, so as to remove electricity after transfer.

20. The image forming apparatus according to claim 18, wherein a time for which said members rotating in contact with said photosensitive member are rotated before said photosensitive member starts to be rotated is 0.01–2.0 seconds.

21. The image forming apparatus according to claim 18, wherein the time for which said members rotating in contact with said photosensitive member are rotated before said photosensitive member starts to be rotated is changed in accordance with the number of pages printed.

22. The image forming apparatus according to claim 21, wherein the time for which said members rotating in contact with said photosensitive member are rotated before said photosensitive member starts to be rotated is reduced each time the number of pages printed reaches the predetermined number.

23. The image forming apparatus according to claim 21, wherein the changing degree of the time for which said members rotating in contact with said photosensitive member before said photosensitive member starts to be rotated is varied in accordance with whether the toner is (a) black toner or (b) cyan toner, magenta toner, or yellow toner.

24. The image forming apparatus according to claim 18, wherein the absolute value of the reversed bias voltage is 5–300 V.

25. The image forming apparatus according to claim 18, wherein said members rotating in contact with said photosensitive member include a roller made of rubber and formed around an axis core, and wherein said rubber has a hardness of 30–80 degrees, a thickness of 0.5–7 mm, and a pressing force with respect to said photosensitive member of 0.5–1.2 kg.

26. The image forming apparatus according to claim 25, wherein said rubber has a hardness of 40–70 degrees and a thickness of 1–5mm.

27. The image forming apparatus according to claim 18, wherein said members rotating in contact with said photosensitive member include a charging roller.

28. The image forming apparatus according to claim 27, wherein said charging roller is made of silicone rubber or urethane rubber.

29. The image forming apparatus according to claim 18, wherein said members rotating in contact with said photosensitive member include a developing roller.

30. The image forming apparatus according to claim 29, wherein said developing roller is made of silicone rubber or urethane rubber.

31. A process cartridge comprising a photosensitive member and at least one member rotating in contact with said photosensitive member, wherein when an image forming operation starts from a standstill, said at least one member rotating in contact with said photosensitive member is controlled to be rotated a predetermined amount of time before said photosensitive member starts to be rotated.

32. The process cartridge according to claim 31, wherein a time for which said members rotating in contact with said photosensitive member are rotated before said photosensitive member starts to be rotated is 0.01–2.0 seconds.

33. The process cartridge according to claim 31, wherein the time for which said members rotating in contact with said photosensitive member are rotated before said photosensitive member starts to be rotated is changed in accordance with the number of pages printed.

34. The process cartridge according to claim 33, wherein the time for which said members rotating in contact with said photosensitive member are rotated before said photosensitive member starts to be rotated is reduced each time the number of pages printed reaches the predetermined number.

35. The process cartridge according to claim 31, wherein said members rotating in contact with said photosensitive member include a roller made of rubber and formed around an axis core, and wherein said rubber has a hardness of 30–80 degrees, a thickness of 0.5–7 mm, and a pressing force with respect to said photosensitive member of 0.5–1.2 kg.

36. The process cartridge according to claim 35, wherein said rubber has a hardness of 40–70 degrees, and a thickness of 1–5 mm.

37. The process cartridge according to claim 31, wherein said members rotating in contact with said photosensitive member include a charging roller.

38. The process cartridge according to claim 37, wherein said charging roller is made of silicone rubber or urethane rubber.

39. The process cartridge according to claim 31, wherein said members rotating in contact with said photosensitive member include a developing roller.

40. The process cartridge according to claim 39, wherein said developing roller is made of silicone rubber or urethane rubber.

41. A process cartridge comprising a photosensitive member and at least one member rotating in contact with said photosensitive member, wherein before said photosensitive member starts to be rotated, a reversed bias voltage that is a voltage opposite to the bias voltage at usual development time is applied between said at least one member rotating in contact with said photosensitive member and said photosensitive member, and the application time of the reversed bias voltage is changed in accordance with the number of pages printed.

42. The process cartridge according to claim 41, wherein the application time of the reversed bias voltage is reduced each time the number of pages printed reaches a predetermined number.

43. A process cartridge comprising a photosensitive member and at least one member rotating in contact with said photosensitive member, wherein before said photosensitive member starts to be rotated, a reversed bias voltage that is a voltage opposite to the bias voltage at usual development time is applied between said at least one member rotating in contact with said photosensitive member and said photosensitive member, and the amount of the reversed bias voltage is changed in accordance with the number of the printed pages.

44. The process cartridge according to claim 43, wherein the amount of reversed bias voltage is reduced each time the number of the printed paper reaches a predetermined number.

45. A process cartridge comprising a photosensitive member and at least one member rotating in contact with said photosensitive member, wherein when an image forming operation starts from a standstill, said at least one member rotating in contact with said photosensitive member is controlled to be rotated a predetermined amount of time before said photosensitive member starts to be rotated, and while said at least one member rotating in contact with said photosensitive member is rotated before said photosensitive member starts to be rotated, a reversed bias voltage that is a voltage opposite to the bias voltage at usual development time is applied between said at least one member rotating in contact with said photosensitive member and said photosensitive member.

46. The process cartridge according to claim 45, further comprising a member for removing electricity, which is in contact with said photosensitive member so as to remove electricity after transfer.

47. The process cartridge according to claim 45, wherein a time for which said members rotating in contact with said photosensitive member are rotated before said photosensitive member starts to be rotated is 0.01–2.0 seconds.

48. The process cartridge according to claim 45, wherein the time for which said members rotating in contact with said photosensitive member are rotated before said photosensitive member starts to be rotated is changed in accordance with the number of pages printed.

49. The process cartridge according to claim 48, wherein the time for which said members rotating in contact with said photosensitive member are rotated before said photosensitive member starts to be rotated is reduced each time the number of pages printed reaches the predetermined number.

50. The process cartridge according to claim 45, wherein the absolute value of the reversed bias voltage is 5–300 V.

51. The process cartridge according to claim 45, wherein said members rotating in contact with said photosensitive member include a roller made of rubber and formed around an axis core, and wherein said rubber has a hardness of 30–80 degrees, a thickness of 0.5–7 mm, and a pressing force with respect to said photosensitive member of 0.5–1.2 kg.

52. The process cartridge according to claim 51, wherein said rubber has a hardness of 40–70 degrees, and a thickness of 1–5 mm.

53. The process cartridge according to claim 45, wherein said members rotating in contact with said photosensitive member includes charging roller.

54. The process cartridge according to claim 53, wherein said charging roller is made of silicone rubber or urethane rubber.

55. The process cartridge according to claim 45, wherein said members rotating in contact with said photosensitive member include a developing roller.

56. The process cartridge according to claim 55, wherein said developing roller is made of silicone rubber or urethane rubber.

* * * * *

UNITED STATES PATENT AND TRADEMARK OFFICE

CERTIFICATE OF CORRECTION

PATENT NO. : 6,567,625 B1
DATED : May 20, 2003
INVENTOR(S) : Tatematsu et al.

It is certified that error appears in the above-identified patent and that said Letters Patent is hereby corrected as shown below:

Title page,
Item [57], ABSTRACT, "photosensitive member stars to be rotated" should read -- photosensitive member starts to be rotated --

Column 20,
Line 27, "accordance with the number pages printed." should read -- accordance with the number of pages --

Column 24,
Line 8, "with said photosentitive member so as to" should read -- with said photosensitive member, so as to --

Signed and Sealed this

Twentieth Day of April, 2004

JON W. DUDAS
*Acting Director of the United States Patent and Trademark Office*